United States Patent [19]

Pollard

[11] Patent Number: 4,878,673

[45] Date of Patent: Nov. 7, 1989

[54] GOLF CLUB SWING TRAINING METHOD

[75] Inventor: Theodore Pollard, Miami, Fla.

[73] Assignee: Objective Golf, Inc., Miami, Fla.

[21] Appl. No.: 145,151

[22] Filed: Jan. 19, 1988

[51] Int. Cl.[4] ..... A63B 69/36

[52] U.S. Cl. ..... 273/186 C; 273/193 A; 272/124

[58] Field of Search ..... 273/413, 414, 412, 58 C, 273/84 R, 193 A, 193 B, 186 A, 186 C, 194 R, 194 A, 194 B, 193 R, 186 R, 183 D, 35 R; 272/124, 67, 68, 128, 123, 93

[56] References Cited

U.S. PATENT DOCUMENTS

| | | | |
|---|---|---|---|
| 645,877 | 3/1900 | Taylor | 273/414 |
| 1,334,188 | 3/1920 | Swan | 273/84 R |
| 1,529,305 | 3/1925 | Gatke | 273/80 B |
| 1,909,932 | 5/1933 | Digel | 273/84 R |
| 1,919,221 | 7/1933 | Janes | 273/77 R |
| 1,930,342 | 10/1933 | Graham | 273/193 R |
| 2,482,015 | 9/1949 | McConnell | 273/194 R |
| 2,684,850 | 7/1954 | Williams | 273/414 |
| 2,848,234 | 8/1958 | Brandon | 273/191 B |
| 3,229,980 | 1/1966 | Silberman | 273/193 R |
| 3,351,346 | 11/1967 | Strahan | 273/193 A |
| 3,428,325 | 2/1969 | Atkinson | 273/186 A |
| 3,554,546 | 1/1971 | Braunhut | 273/84 R |
| 4,343,473 | 8/1982 | Laursen | 273/186 A |
| 4,664,388 | 5/1987 | Huber | 273/186 A |
| 4,693,469 | 9/1987 | Cedar | 272/128 |

*Primary Examiner*—George J. Marlo
*Attorney, Agent, or Firm*—Amster, Rothstein & Ebenstein

[57] ABSTRACT

A golf swing training device comprises a pair of training sticks. Each training stick has a shaft, a weight, and a flexible cable connecting the shaft and the weight. The device is adapted to be utilized by a user grasping a different one of the shafts in each hand and swinging the training sticks in a prescribed pattern of exercise. In one embodiment, the shaft and the weight comprise about 74% and 22%, respectively, of the weight of the training stick, each training stick having a weight of at least 1500 gms. and a length less than about 58 cms.

24 Claims, 4 Drawing Sheets

GOLF CLUB SWING TRAINING METHOD

BACKGROUND OF THE INVENTION

The present invention relates to a sport training device, and more particularly to a golf swing training device and a method of using the same.

Golf training exercises are directed to establishing the most efficient utilization of the energy applied to a golf club so that the club is moved with optimum force in the desired direction to most effectively strike a golf ball. The several forces which are combined to move a golf club through its complete swing are developed in a golfer's body (including the golfer's legs), arms, and wrists. The ideal swing—that is, the movement of the golf club from the beginning of the "backswing" through the end of the "follow-through"—comprises a smooth blending of the various forces generated by the golfer and applied to the club to produce the maximum force obtainable in the club head in the desired direction at the time of impact of the club head with the ball. Any random force applied in directions which do not combine with properly directed forces to produce a maximum resultant force reduce the efficiency and effectiveness of a golfer's swing.

The rocking and torsional movements provided by body action of a golfer are coordinated with his arm swing and wrist cocking and uncocking in such manner that the individual forces from each of these movements are applied to the golf club in the maximum cumulative degree possible to minimize the cancellation, in full or partially, of one force by another. The forces from the body action, the arm swing, and the wrist action preferably are all applied to the golf club in a common plane in which the handle and shaft of the club together move through the swing with the point of impact of the club head and the golf ball also lying in this plane. The resultant force with which the club head strikes the ball is preferably as near as practicable the sum of these individual forces. Obviously, random or transient forces applied from the body, arms, or wrists of the golfer to the handle of the club reduce the magnitude of the force being applied to the club head into the common plane and necessarily changes the direction and magnitude of the ultimate resultant force applied to the golf ball.

Regrettably, even diligent practice of a swing with a golf club does not necessarily lead to improvement of the swing. The golf club frequently fails to indicate to the user that an error is being committed in the swing so the user ends up making the same mistake over and over again, thereby developing a "muscle memory" (i.e., a set behavioral pattern at the muscle level) which includes the error. Thus practice swinging may indeed have a negative effect unless a skilled trainer is present to observe and report to the user on errors noted in the practice swings.

Even where the user is aware of the error in the muscle memory and attempts to consciously correct the same in his practice swings, it is difficult to overcome the established muscle memory and establish a new one in direct opposition to the established muscle memory.

Accordingly, it is an object of the present invention to provide a golf swing training device which makes evident errors in the swing.

Another object is to provide such a device which assists in building new muscle memory for a correct swing without directly opposing the established muscle memory for a defective swing.

A further object is to provide such a device which can be used in different configurations for different training exercises.

It is also an object to provide such a device which is of safe and economical construction, easy to maintain and use.

It is a further object to provide a method of using such a device to correct swinging errors.

SUMMARY OF THE INVENTION

It has now been found that the above and related objects of the present invention are attained in a golf swing training device comprising a pair of training sticks. Each of the training sticks has a shaft having upper and lower ends, a weight, and flexible elongate means connecting the lower end of the shaft and the weight. The device is adapted to be utilized by a user grasping a different one of the shafts in each hand and swinging the training sticks in a prescribed pattern of exercise.

In a preferred embodiment, the elongate means comprises a cable, is of fixed length, and is short relative to the shaft. The weight has upper and lower portions and the elongate means connects the shaft lower end and the weight upper portion so that the maximum separation of the shaft upper end and the weight lower portion is substantially less than the length of a golf club, and preferably less than 58 cms. (23 ins.). Each weight is about 94 gms. (0.37 lbs.) and about 6.4 gms. (2.5 ins.) in diameter. The shaft comprises about 74% by weight of the device, and the weight about 22%.

Preferably, the device further comprises means for connecting the shafts at a selected point along their lengths to provide a maximum separation therebetween at the points. The connecting means is flexible, connects the shaft upper ends, and provides a variable maximum separation between the shafts at the points. Each of the shaft upper ends may define attachment means, with the connecting means comprising a non stretchable means of variable effective length for interconnecting the attachment means. The connecting means preferably enables the shafts to be held by a spaced pair of back-to-back hands or a spaced pair of palm-to-palm hands.

In certain exercises an improper swing is evidenced by a non-parallel relation between the training sticks during a swing, and a proper swing is evidenced by a parallel relation between the shafts during a swing.

In another preferred embodiment, the golf swing training device comprises a pair of training sticks wherein the shaft and the weight comprising about 74% and about 22%, respectively, by weight of each training stick, each training stick having a weight of at least 1500 gms. (1.7 lbs.) and a length less than about 58 cms. (23 ins.).

In the training method the present invention further encompasses a method of training oneself to properly swing a golf club comprising the steps of providing the golf swing training device and practicing swinging the training sticks with each hand holding a different one of the shafts.

The shafts are held with the hands in either a wrist-crossed generally back-to-back relation or a non-crossed generally palm-to-palm relation. Preferably, the connecting means is adjusted to enable a desired maximum separation between the shafts.

BRIEF DESCRIPTION OF DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
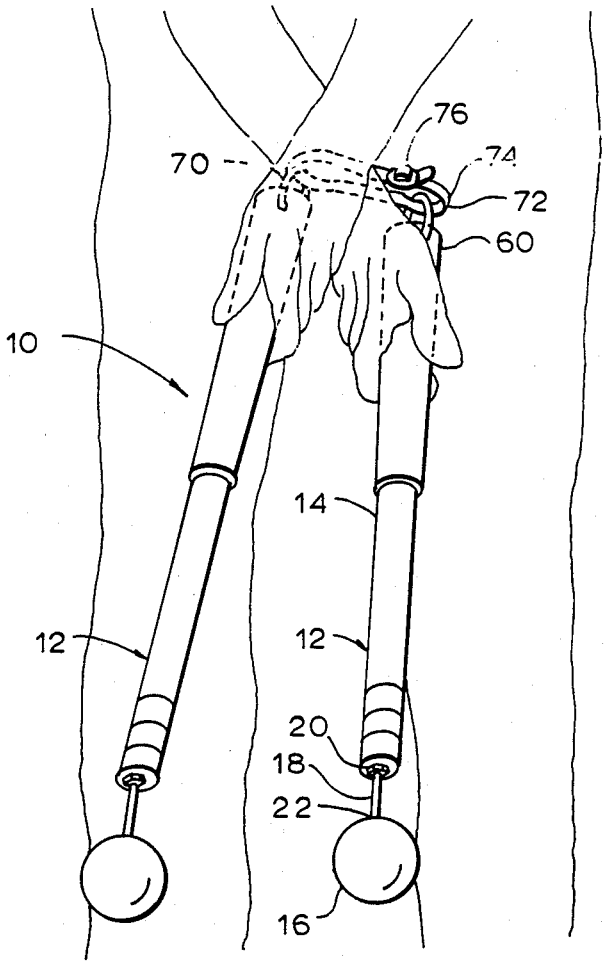
FIG 1 is a fragmentary isometric view of a golf swing training device according to the present invention held by the user in a crosshanded back-to-back hand position.
Figure 5:
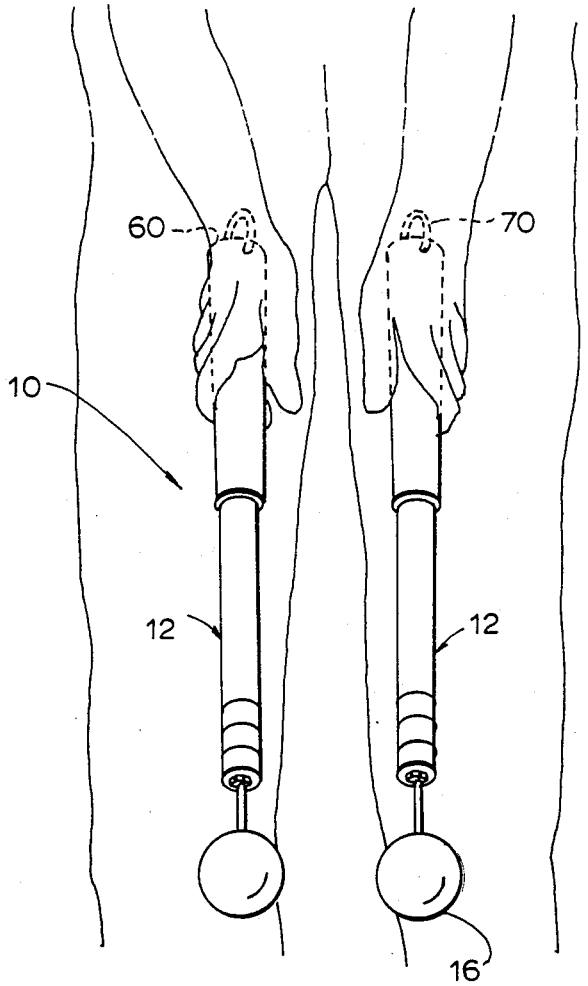
FIG. 5 is a fragmentary isometric view of the device held by the user in the separate hand position.
Figure 9:
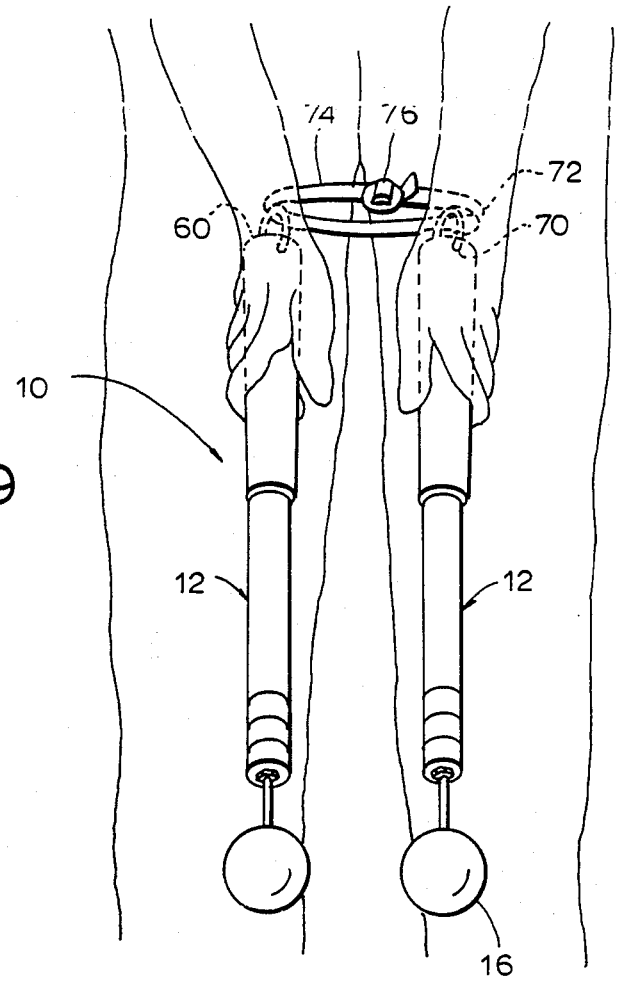
FIG. 9 is a fragmentary isometric view of the device held by the user in a non-crossed palm-to-palm hand position.

Referring now to FIGS. 1, 5 and 9, therein illustrated are golf swing training devices, generally designated by the reference numeral 10, according to the present invention. Each of the golf swing training devices 10 is comprised of a pair of training sticks generally designated 12. The device 10 is adapted to be utilized by a user grasping a different one of the training sticks 12 in each hand and swinging the training sticks in a prescribed pattern of exercise, as will be explained in greater detail hereinafter. Because the user's hands are not both holding a single golf club, as golf is usually played, there is less tendency for the established "muscle memory" incorporating the past swing errors to be carried over into drills performed with the training device—i.e., where each hand holds a separate training stick. At the same time, the new "muscle memory" being developed by the training exercises carries over to later play with both hands on a single golf club and, if sufficiently developed, is capable of overcoming the prior muscle memory.

Each training stick 12 has a shaft 14, a weight 16 and flexible elongate means such as a cable 18 connecting the lower end 20 of the shaft 14 and the upper portion 22 of the weight 16. The training stick 12 preferably has a weight of at least 1500 grams, the shaft 14 and weight 16 comprising about 74% and about 22%, respectively, of the weight of the training stick 12. The training stick has a maximum length less than that of a golf club and preferably less than about 58 centimeters (23 ins.).

Figure 13:
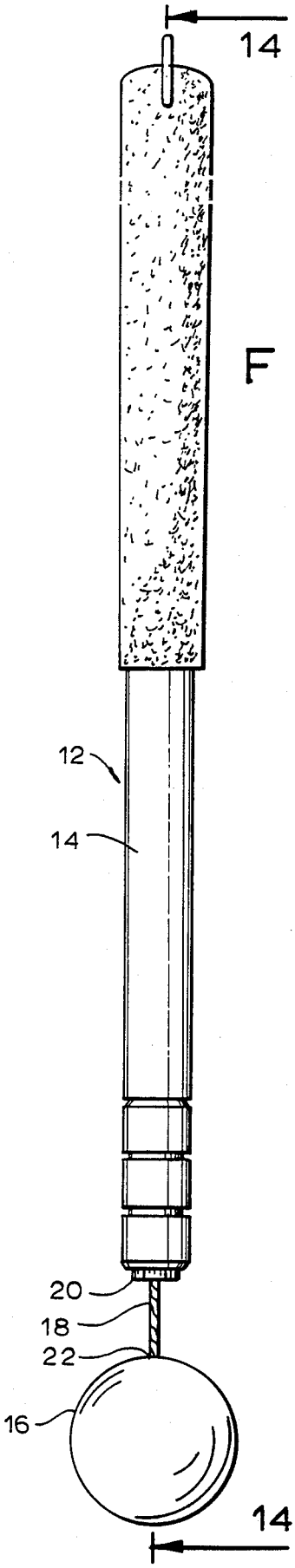
FIG. 13 is a front elevation view of a training stick according to the present invention.
Figure 14:
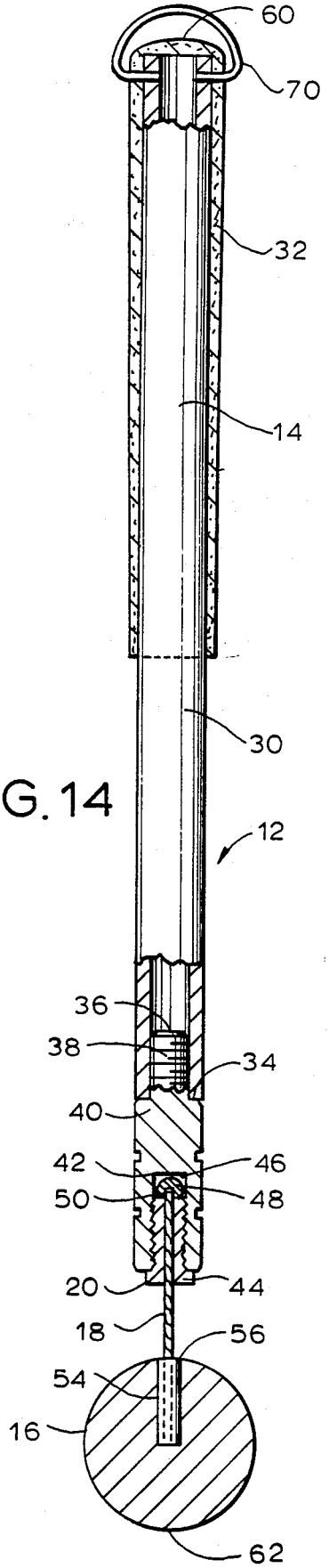
FIG. 14 is a sectional view taken along the line 14—14 of FIG. 13, with portions being cut away to reveal details of construction.

Referring now in particular to FIGS. 13 and 14, therein illustrated in further detail is a training stick 12 according to the present invention. The shaft 14 is formed substantially of a hollow cylindrical pipe 30. Approximately the upper half of the pipe 30 is provided with a slightly resilient molded grip which may bevel slightly inwardly from the top to the bottom. The bottom 34 of the pipe 30 defines an internally threaded aperture 36 adapted to receive the externally threaded end 38 of a bushing 40 which extends downwardly from the bottom 34 of the pipe 30 almost to the bottom 20 of the shaft 12. The bottom end of the bushing 40 defines an aperture 42, which is internally threaded adjacent the bottom thereof to receive therein an externally threaded portion of a fastener 44. The upper end of the fastener 44 and the upper end of the aperture 42 define therebetween a small chamber 46. The fastener 44 defines a central longitudinal passageway therethrough, and the upper portion of cable 18 extends through the passageway and into the chamber 46 where a ball 48 is press fit onto the exposed end 50 of the cable 18 to preclude retreat of the cable 18 from the fastener 44, and hence from the training stick shaft 14. The cable 18, fastener 44, ball 48 and bushing 40 are assembled by inserting the top of cable 18 through the longitudinal passageway in the fastener 44, press-fitting the ball 48 about the exposed end 5 of the cable 18 and then threading the fastener 44 into the aperture 42 of the bushing 40 so that the ball 48 fits within the chamber 46.

The lower portion of the cable 18 is press fit into an aperture 54 in the weight 16, typical using a deformable sleeve 56 about the lower portion of the cable 18. Each weight 16 is about 94 grams (0.37 lbs.) and about 6.4 cms. (2.5 ins.) in diameter. The weight 16 is preferably configured as a sphere, as illustrated, although cylindrical and other shapes may also be utilized. The weight is preferably formed of a rigid plastic such as a phenolic. The free swinging weights train the ligaments and muscles of the hands, wrists and forearms to work together, while developing and tightening control of the swing. In certain exercises movement of the weights 16 ahead of the wrists, and a consequent loss of stick control, may indicate an error in the swing.

Cable 18 may be any flexible cable, chain, ribbon or the like of fixed length. The length of cable 18 is short relative to the length of the shaft 14 so that the maximum separation of the shaft upper end 60 and the weight lower portion 62 is less than the length of a standard golf club, and preferably less than about 58 cms. (23 ins.).

The pipe 30 may be about 2.5 cms. (1 in.) O.D. polyvinyl chloride pipe, the cable 18 may be a 0.32 cm. ($\frac{1}{8}$ in.) stainless steel cable, and the bushing may be cold rolled steel, although clearly other materials and sizes may be used. The shaft preferably has a length of less than 48 cms. (19 ins.).

The golf swing training device of the present invention further encompasses means for connecting the shafts 14 at a selected point along their lengths to provide a maximum separation therebetween at such points. More particularly, each of the shaft upper ends 60 defines an attachment means 70, such as a D-ring pivotally mounted through the mold grip 32 and cylindrical body 30 adjacent the upper end 60 of the shaft 14. As illustrated in FIGS. 1 and 9, connecting means 72 interconnect the attachment means 72 and hence the shafts 14 of sticks 12. The connecting means 72 comprises a non-stretchable means, such as a cloth or leather strap, of variable effective length. As illustrated, the connecting means 72 is in combination a cloth strap 74 an a sturdy automatically locking fastener means 76 which enables adjustment of the effective length of the strap 74 and hence the maximum separation between the shafts 14. The strap 74 should be flexible so that it limits the separation between the shafts 14, but does not otherwise interfere with the movement of one stick relative to another. Thus, the shafts 14 may be held by a spaced pair of back-to-back hands as illustrated in FIG. 1 or a spaced pair of palm-to-palm hands as illustrated in FIG. 9. The fastener 76 should further enable removal of the strap 74 entirely from at least one stick 12, and preferably both sticks 12, so that the device 10 may be utilized for exercises wherein each stick 12 is swung independently of the other, as illustrated in FIG. 5.

Exercise #1

Referring now to FIGS. 1–4, therein illustrated is the use of the golf swing training device 10 in a crosshanded drill or training exercise designed to decrease shoulder spin, one of the three major swing errors. When the shoulder spins during the down swing, it moves the club head outside the imaginary line to the target ball, with the end result being a pull or slice. For the crosshanded drill designed to counter shoulder spin, the length of the strap is adjusted to provide a maximum separation between the shaft upper ends 60 of about 17.8 cms. (7 ins.). Then the grips 32 are grasped, one in each hand, with the hands (i.e., wrists) being crossed in front of the user, with the right hand under and the strap 74 running under the right hand, not between the hands.

Figure 2:
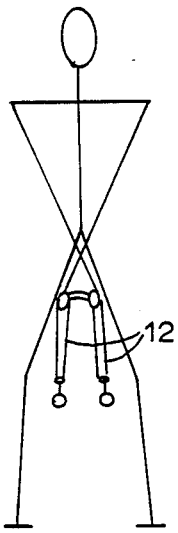
FIGS. 2–4 are sequential schematic illustrations of a user doing a crosshanded exercise designed to correct shoulder spin.
Figure 3:
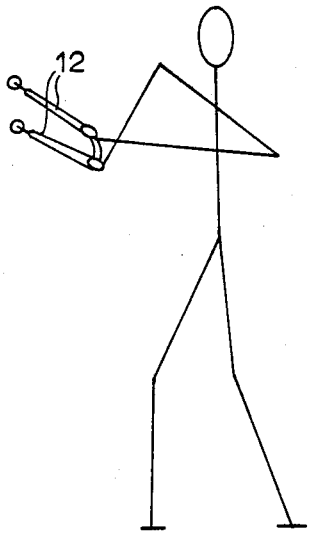
Figure 4:
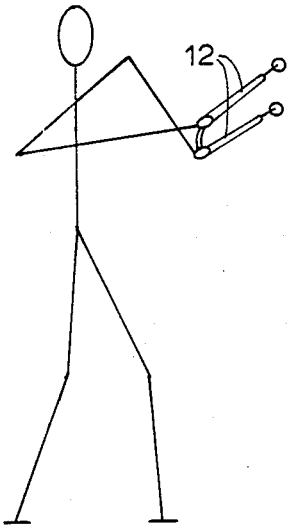

From the initial position illustrated in FIG. 1 and 2, the user swings the sticks 12 back to the half-swing position illustrated in FIG. 3, with the left arm extended and the right elbow pointed at the hip. The stick ends 60 should be pointed at the target ball. Next the user pulls down with his left arm, keeping the ends of the sticks pointed at the target ball. The hands are rotated through the impact zone and finish at the half-swing position illustrated in FIG. 4, with the stick ends 60 pointing at the target ball.

Because of the crosshand position and the force of the swinging balls 16, the shoulder is moved downwards and inwards during the drill, making it impossible for the club head (if the sticks 12 were golf clubs) to cross outside the imaginary line to the target ball.

To insure that both arms develop equally, the shafts 14 should be kept parallel during the swing. If the shafts crossover or spread apart during the swing (i.e., assume a non-parallel relation), one hand or the other is dominating.

Exercise #2

Referring now to FIGS. 5–8, therein illustrated is the use of the device 10 in an alternate hit or alternate hand drill designated to decrease casting of the club, another major swing error. In casting of the club, the club is simply cast down from the top of the down swing (like a fisherman casting a rod), thereby releasing the available energy from the hands, wrists and forearms before the club is in the impact zone. The alternate hit drill programs the hands, wrist and forearms to stop this error. For the alternate hit drill, the strap 74 is removed from the sticks 12, and the shafts 14 are held spaced apart by a pair of hands in palm-to-palm relation.

Figure 6:
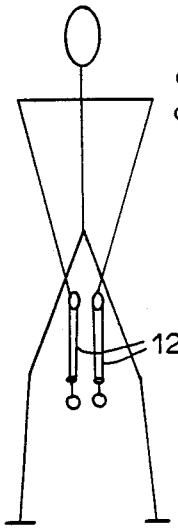
FIGS. 6–8 are sequential schematic illustrations of a user doing a separate hand exercise to correct casting of the club.
Figure 7:
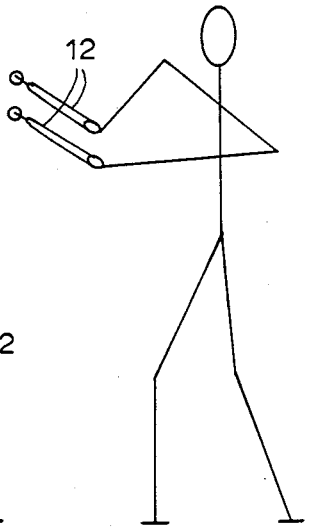
Figure 8:
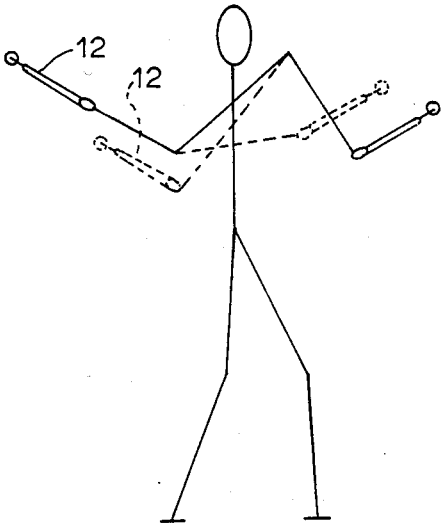

From the initial position illustrated in FIGS. 5 and 6, the user swings both sticks back to the half-swing position illustrated in FIG. 7, with the left arm extended and the right elbow pointed at the hip. The stick ends 60 should be pointed at the target ball. Referring now to FIG. 8, as the right hand is held in position, the left hand is swung through the impact zone until, at the end of the swing, the stick end 60 is pointed at the target ball. Then the left hand is returned to the half-swing position and held there (see phantom line representation), while the right hand is swung up from underneath the extended left arm through the impact zone, finishing the swing with the stick end 60 pointing at the target ball (see phantom line representation). Then the right hand is returned to underneath the extended left arm, finishing again with both stick ends 60 pointing at the target ball. Alternate swings are then continued.

Casting of the sticks 12 during the down swing causes the weights 16 to move ahead of the wrist with a jerking motion, thus making the sticks more difficult to control and evidencing the error in the stroke.

Exercise #3

Referring now to FIGS. 9–12, therein illustrated is the use of the device 10 in a hand rotation drill designed to overcome inadequate hand rotation, the third major swing error. When the hands fail to rotate as the club head passes through the impact zone, the club head is open to the target line on impact, with the frequent result being a ball headed for the woods. The rotation drill programs the hands and the wrist to rotate at the right place at the right time during the swing. For the rotation drill, the strap is set for a maximum separation of about 10.2 cms. (4 ins.) between the stick upper ends 60. The knees are slightly bent, with the feet about 15.2 cms. (6 ins.) apart.

Figure 10:
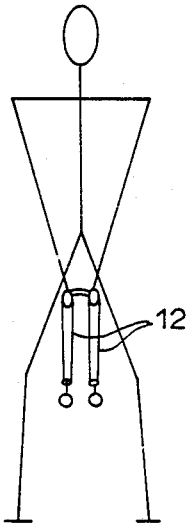
FIGS. 10–12 are sequential schematic illustrations of a user doing a non-cross handed exercise designed to improve hand rotation.
Figure 11:
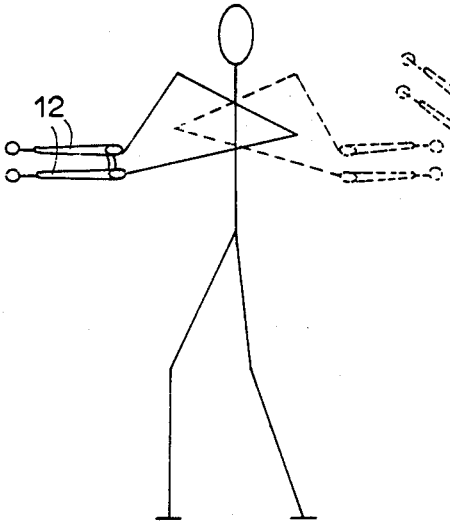
Figure 12:
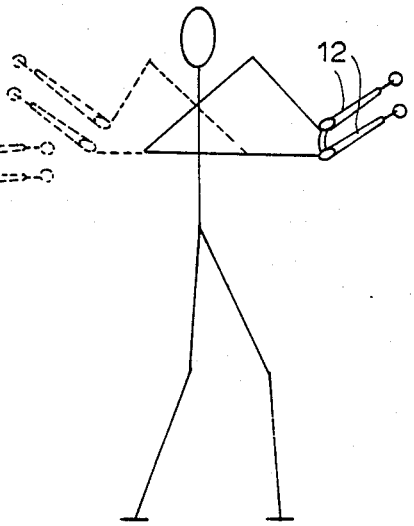

From the initial position illustrated in FIGS. 9 and 10, the sticks are swung back to the quarter-swing position illustrated in phantom line in FIG. 11, with the sticks parallel to each other and with the ground. The left arm is straight and the right elbow is tucked into the hip. The sticks are then swung forward to the quarter-swing position illustrated in solid line in FIG. 11. After about ten swings, the left foot is moved further away from the right foot (toward the target ball) so that the feet are about shoulder width apart. The swings are increased to half-swings and repeated ten more times a illustrated in FIG. 12, the back half-swing in phantom line and the forward half-swing in solid line.

While the three drills or training exercises illustrated—the crosshand drill (FIGS. 1–4), the alternate hit drill (FIGS. 5–8) and the rotation drill (FIGS. 9–12)—are directed respectively to the three most common problems—shoulder spin, casting the club, and failing to rotate the hands—the device may also be used in other training exercises or drills as well as for warm-up purposes and the like. The drills are directed to the most efficient utilization of the energy applied in the golf swing so that, in play, the club will be moved with optimum force in the desired direction to most effectively strike a golf ball while minimizing the application of random force in any direction which does not combine with properly directed forces to produce a maximum resultant force.

It will be appreciated that in most instances the device signals to the user when the swing is improper, either by feel, by non-parallel positioning of the shafts 14 or by the weights 16 leading the wrists 14.

To summarize, the present invention provides a golf swing training device which makes evident errors in the swing, and assists in building new muscle memory for corrected swing without directly opposing the established muscle memory for a defective swing. The device can be used in different configurations for different training exercises and is of a safe and economical construction, easy to maintain and use.

Now that the preferred embodiments of the present invention have been shown and described in detail, various modifications and improvements thereon will be readily apparent to those skilled in the art. Accordingly, the appended claims should be construed broadly in a manner consistent with the spirit and scope of the invention herein.

We claim:

1. A method of training oneself to properly swing a golf club comprising the steps of:

(A) providing a golf swing training device comprising a pair of training sticks, separate and independently movable relative to one another, each of said training sticks having a shaft having upper and lower ends, a weight, and flexible elongate means of fixed length connecting said lower end of said shaft and said weight; and (B) practicing movements associated with a golf swing while swinging the training sticks in a prescribed pattern of exercise with each hand holding a different one of the shafts by an upper end thereof.

2. The method of claim 1 wherein said elongate means comprises a cable.

3. The method of claim 1 wherein the length of said elongate means is short relative to the length of said shaft.

4. The method of claim 1 wherein said weight has upper and lower portions and said elongate means connects said shaft lower end and said weight upper portion so that the maximum separation of said shaft upper end and said weight lower portion is less than about 58 cms (23 ins.).

5. The method of claim 1 wherein each said weight is about 94 gms. (0.37 lbs.).

6. The method of claim 1 wherein each said weight is about 6.4 cms (2.5 ins.) in diameter.

7. The method of claim 1 wherein said shaft comprises about 74% by weight of said device, and said weight about 22%.

8. The method of claim 7 wherein the device also includes means for connecting said shafts at a selected point along their length to limit separation therebetween at said points.

9. The method of claim 8 wherein said connecting means is flexible.

10. The method of claim 8 wherein said connecting means connects said shaft upper ends.

11. The method of claim 8 wherein said connecting means provides a variable maximum separation between said shafts at said points.

12. The method of claim 10 wherein said variable maximum separation is about 7.6–25.4 cms (3–10 ins.)

13. The method of claim 8 wherein each of said shaft upper ends defines attachment means, and said connecting means comprises a non-stretchable means of variable effective length for interconnecting said attachment means.

14. The method of claim 8 wherein said connecting means enables said shafts to be held by a spaced pair of back-to-back hands.

15. The method of claim 8 wherein said connecting means enables said shafts to be held by a spaced pair of palm-to-palm hands.

16. The method of claim 1 wherein said training sticks are configured and dimensioned such that in certain training exercises an improper swing is evidenced by a non-parallel relation between said training sticks during a swing and a proper swing is evidenced by a parallel relation between said shafts during a swing.

17. The method of claim 1 wherein said elongate means is configured and dimensioned such that in certain training exercises an improper swing is evidenced by said weight leading the wrists on the down stroke, whereby control of the stick is rendered more difficult.

18. The method of claim 1 wherein in step (B) the shafts are held with the hands in a crossed generally back-to-back relation.

19. The method of claim 1 wherein in step (B) the shafts are held with the hands in a non-crossed generally palm-to-palm relation.

20. The method of claim 1 wherein the device includes means for connecting the shafts, each at a selected point along its length to variably limit separation therebetween at the points, and step (A) includes adjusting the connecting means to provide the desired limit on separation between the shafts at the points.

21. The method of claim 20 wherein in step (B) the shafts are held with the hands in a crossed generally back-to-back relation, and the user swings the training sticks together while maintaining the shafts as close to parallel as possible during the swing and a non-parallel relation between the shafts during the swing evidences that one hand or the other is dominating.

22. The method of claim 20 including the step of connecting the shafts with the connecting means at the upper ends thereof to limit separation therebetween at the upper ends.

23. The method of claim 1 wherein the user swings the training sticks separately while maintaining his wrist, the shaft and the weight aligned during each down swing as much as possible and the weight moving ahead of the shaft and wrist with a jerking motion evidences casting.

24. The method of claim 1 wherein the prescribed pattern of exercise causes the orientation of the training sticks during the practice swings to evidence an improper practice swing.

* * * * *